US009027168B2

(12) United States Patent
Heyerdahl

(10) Patent No.: US 9,027,168 B2
(45) Date of Patent: May 12, 2015

(54) URINATION OPENING IN MEN'S UNDERWEAR

(76) Inventor: Torjus Heyerdahl, Drammen (NO)

( * ) Notice: Subject to any disclaimer, the term of this patent is extended or adjusted under 35 U.S.C. 154(b) by 1013 days.

(21) Appl. No.: 13/041,351

(22) Filed: Mar. 4, 2011

(65) Prior Publication Data

US 2012/0222196 A1 Sep. 6, 2012

(51) Int. Cl.
*A41B 9/02* (2006.01)

(52) U.S. Cl.
CPC ..... *A41B 9/026* (2013.01)

(58) Field of Classification Search
USPC ..... 2/79, 227, 228, 238, 456, 465, 466, 69, 2/400, 403, 404, 405, 407
See application file for complete search history.

(56) References Cited

U.S. PATENT DOCUMENTS

| | | | | | |
|---|---|---|---|---|---|
| 887,450 | A | * | 5/1908 | Wootton | 602/69 |
| 2,601,602 | A | * | 6/1952 | Firsching, Sr. | 602/67 |
| 4,195,630 | A | | 4/1980 | Connery et al. | |
| 4,377,008 | A | | 3/1983 | Jung | |
| 4,759,355 | A | * | 7/1988 | Thrower | 602/67 |
| 5,283,912 | A | | 2/1994 | Yil | |
| 5,290,270 | A | | 3/1994 | Fisher | |
| 5,499,404 | A | | 3/1996 | Marchiorello | |
| 5,535,452 | A | | 7/1996 | Rozenblat | |
| 5,984,910 | A | | 11/1999 | Berke | |
| 6,041,445 | A | | 3/2000 | Davitt | |
| 6,047,408 | A | | 4/2000 | Brill, Jr. | |
| 7,685,651 | B2 | | 3/2010 | Yoo | |

FOREIGN PATENT DOCUMENTS

| | | | |
|---|---|---|---|
| GB | 2333945 | A | 8/1999 |
| GB | 2403642 | A | 1/2005 |
| JP | 7166401 | A | 6/1995 |
| JP | 9157905 | A | 6/1997 |
| JP | 2002309401 | A | 10/2002 |
| JP | 2010070895 | A | 4/2010 |
| WO | 2005/046369 | A2 | 5/2005 |
| WO | 2007004423 | A1 | 1/2007 |
| WO | 2007004826 | A1 | 1/2007 |

* cited by examiner

*Primary Examiner* — Tejash Patel
(74) *Attorney, Agent, or Firm* — Jeffrey Parry Intellectual Property Law Group PLLC; Jeffrey C. Parry

(57) ABSTRACT

A fabric assembly attachable to the front side of a men's underwear and a men's underwear having such a fabric assembly are described. The fabric assembly has layers of fabrics having linear slots perpendicular to each other so that the wearer can take his genital organ out through the intersection of the linear slots. The peripheries of the fabric layers are elastically stitched together to make a fabric assembly. The fabric layers have sufficient rigidity such that the linear slots do not open under the pressure of the genital organ, unless the wearer uses his hands to open the slots. The fabric assembly may also have a flap on the inside or outside of the fabric layers. One or two sides of the flap may be attached to the men's underwear and the other sides may not be attached to permit easy opening of the flap by hand.

20 Claims, 4 Drawing Sheets

URINATION OPENING IN MEN'S UNDERWEAR

CROSS-REFERENCE TO RELATED APPLICATIONS

Not Applicable

STATEMENT REGARDING FEDERALLY SPONSORED RESEARCH AND DEVELOPMENT

Not Applicable.

FIELD OF THE INVENTION

This invention relates to the field of men's underwear, and more particularly to the field of men's underwear having the functionality of convenience in urination.

DISCUSSION OF RELATED ART

Men's underwear devised for facilitating convenient taking out of men's genital organ for urination are known to exist. For example, U.S. Pat. No. 5,630,232 to Miller discloses an undergarment with a linear fly opening covered by a pair of flaps.

However, the prior art does not describe a men's undergarment with a combination of fabric layers having a plurality of linear slots enabling the wearer to conveniently take his genital organ out of his underwear for urination, while securely covering the genital organ when not urinating.

SUMMARY OF INVENTION

A men's underwear having a fabric assembly designed to facilitate easy taking out of a man's genital organ for urination and secure covering of the genital organ when not urinating is described.

In an embodiment of the invention, the fabric assembly comprises an inner fabric layer having a first linear slot and an outer fabric layer having a second linear slot. The peripheries of the two layers are elastically stitched together to form the fabric assembly. The assembly is elastically stitchable to the front side of an underwear. The fabric layers have sufficient rigidity such that the linear slots do not open on their own unless the wearer uses his hands to open the slots.

In another embodiment, the inner fabric layer has a horizontal linear slot and the outer fabric layer has a vertical linear slot. In other embodiments, the two linear slots may not be perpendicular to each other and may form an angle different from a right angle.

In another embodiment, the assembly may also have a fabric flap on the inside or outside of the two linear slots and wherein the top side of the flap is attachable to the underwear, while the other three sides of the flap are not attached. In another embodiment, the top side and an adjacent side other than the bottom side may be attached to the underwear and the other two sides may be unattached.

In some embodiments, the flap may on the inside of the fabric layers, while in some other embodiments the flap may on the outside of the fabric layers.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENTS

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Like numerals in different figures refer to the same parts. Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The problem of enabling a man to conveniently take his genital organ out of his underwear for urination and secure covering of the genital organ when not urinating is solved by attaching a fabric assembly to the front side of the underwear, the fabric assembly constructed by stitching together fabric layers having linear slots on the two layers perpendicular to each other and the fabric layers having sufficient rigidity such that the linear slots do not open under the pressure of the genital organ, unless the wearer opens the linear slots using his hands.

Figure 1:
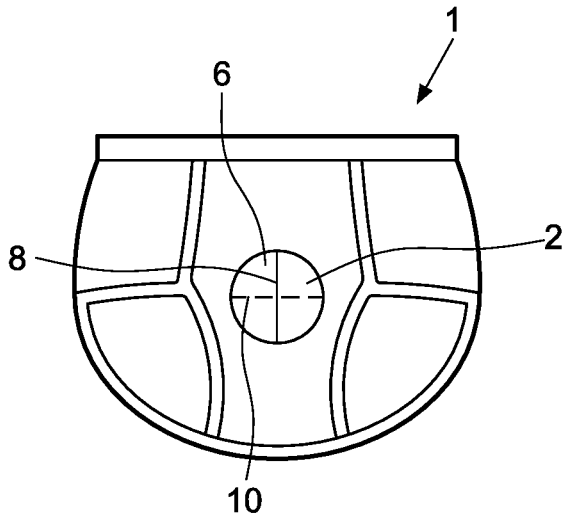
FIG. 1 shows the front view of a men's underwear having a fabric assembly elastically stitched to the front side of the underwear.

In an embodiment of a men's underwear shown in FIG. 1, the men's underwear 1 has a fabric assembly 2 elastically stitched to an opening 6 on the front side of the underwear 1 to enable the wearer to conveniently take out his genital organ for urination, etc. The opening 6 may have a variety of shapes, for example, circular, elliptical, rectangular, square, etc. The fabric assembly 2 will generally be of the same size and shape as the opening 6 on the front side of the men's underwear 1. The edges of the fabric assembly 2 are elastically stitched to the edges of the opening 6 on the front side of the men's underwear 1.

Figure 2:
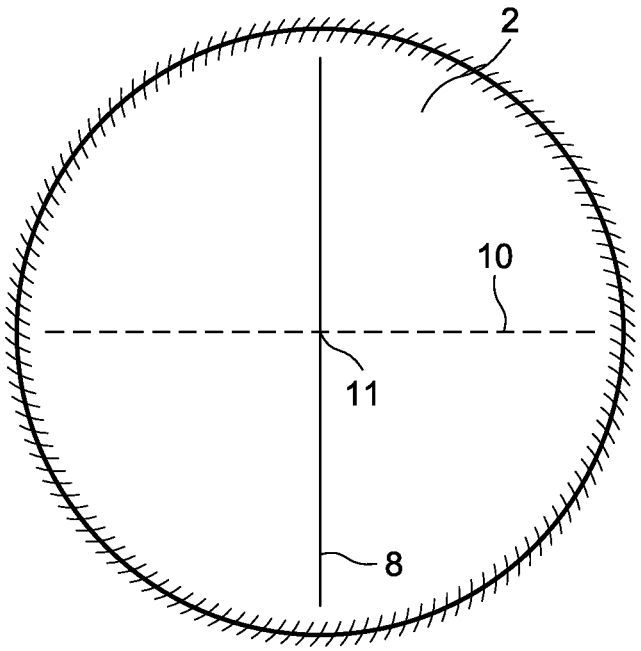
FIG. 2 shows the front view of an embodiment of a fabric assembly made by elastically stitching together the peripheries of an inner fabric layer and an outer fabric layer, the two layers having linear slots.
Figure 3:
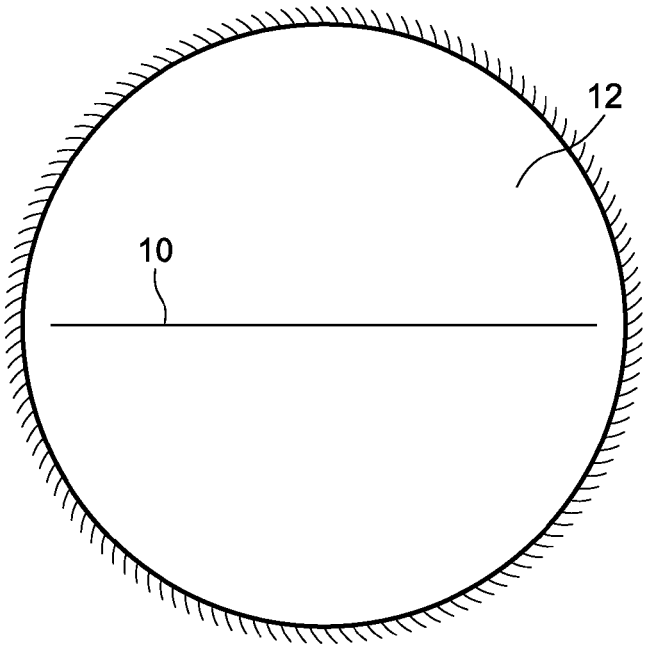
FIG. 3 shows an embodiment of the inner fabric layer having a horizontal linear slot.
Figure 4:
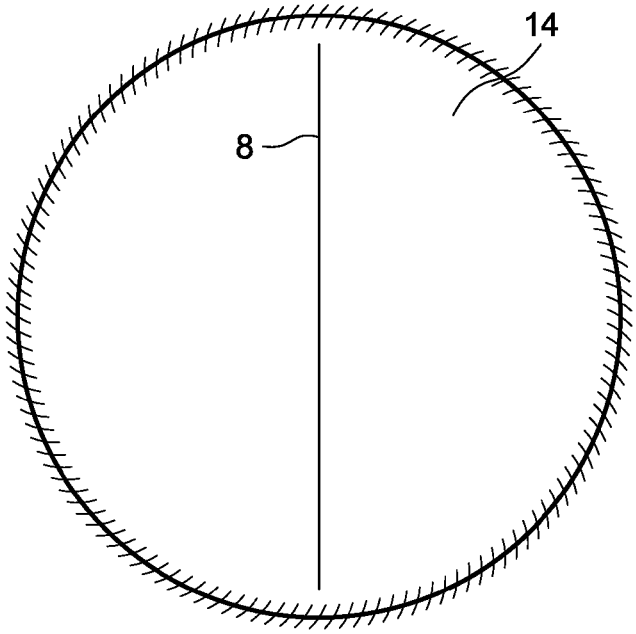
FIG. 4 shows an embodiment of the outer fabric layer having a vertical linear slot.

In an embodiment shown in FIG. 2, the fabric assembly 2 is made by elastically stitching together the peripheries of an inner fabric layer 12 (FIG. 3) and an outer fabric layer 14 (FIG. 4).

The inner fabric layer 12 has a horizontal linear slot 10 (FIG. 3) and the outer fabric layer 14 has a vertical linear slot 8 (FIG. 4). The two linear slots intersect at a point 11 as shown in the fabric assembly 2 in FIG. 2.

The linear slots 8 and 10 are perpendicular to each other in the embodiment of the fabric assembly 2 shown in FIG. 2. In other embodiments (not shown) of the fabric assembly, the linear slots may not have horizontal or vertical alignment, but may still be perpendicular to each other. In still other embodiments (not shown), the linear slots may not even be perpendicular to each other. The intersection 11 (shown in FIG. 2) of the two linear slots is aligned to the genital organ of the wearer. The wearer of the underwear can use his hand to take his genital organ out through the intersection 11 of the two linear slots 8 and 10.

Figure 5:
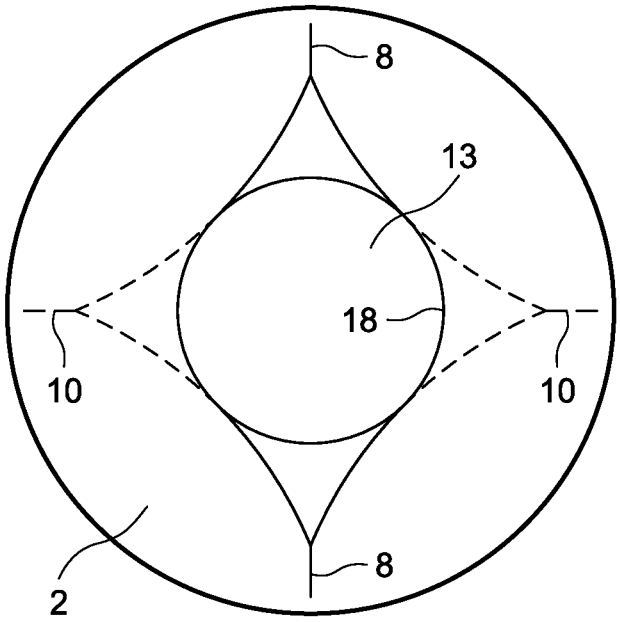
FIG. 5 shows a front view of the underwear when the underwear is in an open position for urination.

FIG. 5 shows a front view of the fabric assembly 2 (FIG. 2) attached to the underwear when the underwear is in an open position for urination. The vertical slot 8 and the horizontal slot 10 shown in the other figures are shown in FIG. 5 in an open position of the underwear during urination. The edges of the slots 8 and 10 of the fabric assembly 2 are opened by hand to create an opening 13 for the genital organ to be taken out when urination occurs. The visible edges of the horizontal slot 10 in the inner fabric layer in the open position are shown as 28 and 29. The visible edges of the vertical slot 8 in the outer fabric layer in the open position are shown as 30 and 27. The horizontal slot 10 in the inner fabric layer is partly visible and partly hidden as shown by solid and dashed lines respectively. The fabric layers have sufficient rigidity so that the genital organ does not come out through the two linear slots under the pressure of the genital organ, unless the wearer uses his hand to open the slots.

Figure 6:
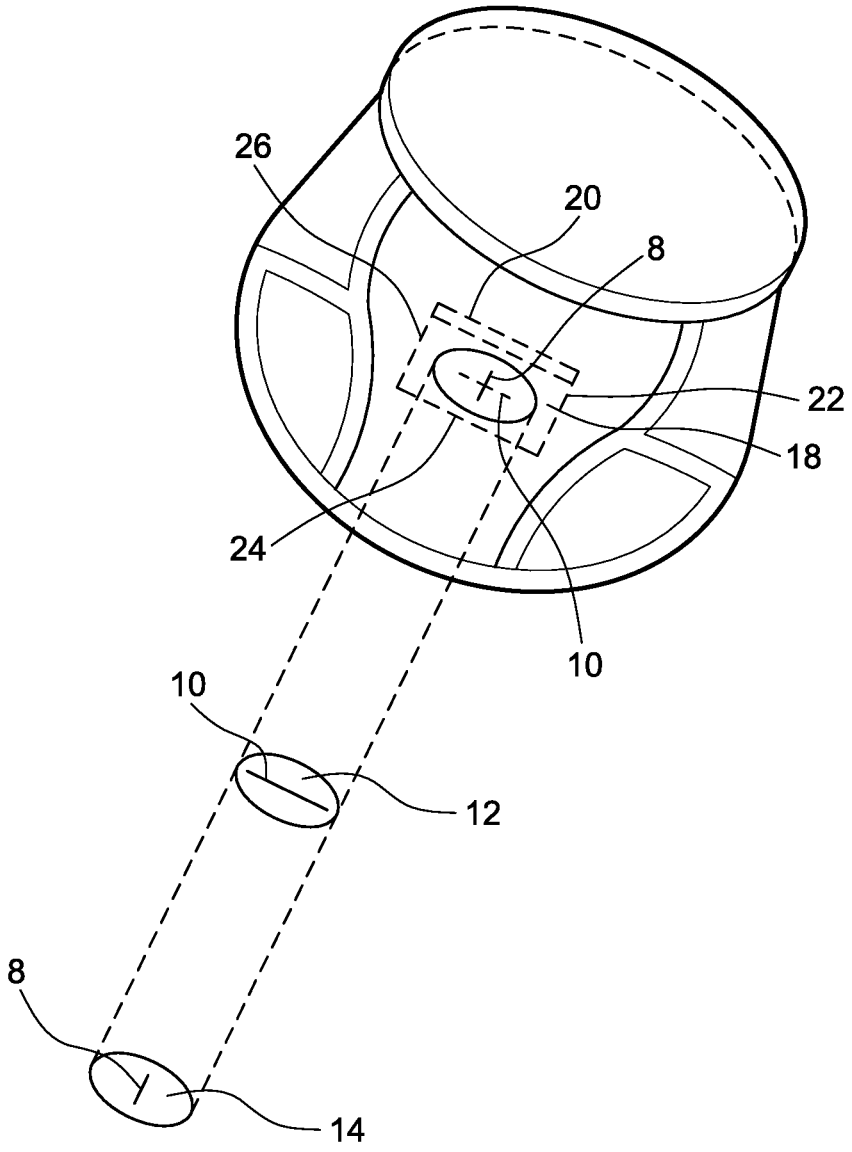
FIG. 6 shows a perspective view of an embodiment of an underwear having a fabric assembly with a flap on the inside of the fabric layers having linear slots.

In another embodiment shown in FIG. 6, the fabric assembly is made by elastically stitching together a flap 18 on the inside of the fabric layers 12 (FIG. 3) and 14 (FIG. 4). The top end 20 (shown as double dashed lines) of the flap 18 may be attached to the underwear, but the other three sides 22, 24, and 26 of the flap 18 may not be attached to the underwear. This construction enables the wearer to easily turn the flap up and take out his genital organ through the intersection of the two linear slots 8 and 10. In another embodiment (not shown), the top side and an adjacent side other than the bottom side may be attached to the underwear, but the other two sides are not attached to the underwear. In still other embodiments (not shown), the flap may be on the outside of the fabric layers having linear slots.

In other embodiments, the fabric assembly may comprise three fabric layers having linear slots.

The underwear manufacturer may make the assembly himself or source it from a vendor.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other articles, not necessarily the article described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A fabric assembly attachable to the front side of a men's underwear, the assembly comprising:

an inner fabric layer having a first linear slot; and an outer fabric layer having a second linear slot perpendicular to the first linear slot in the inner fabric layer, the fabric assembly formed by elastically stitching together the periphery of the inner fabric layer to the periphery of the outer fabric layer, the fabric assembly elastically stitchable to an opening on the front side of a men's underwear, and the fabric assembly having sufficient rigidity such that the first linear slot and the second linear slot do not open under the pressure of the genital organ, unless the wearer uses his hands to open the slots.

2. The assembly of claim 1, the assembly further comprising a fabric flap adjacent to the first linear slot and the second linear slot.

3. The fabric assembly of claim 2, wherein the flap is positioned on the inside of the inner fabric layer and the outer fabric layer.

4. The fabric assembly of claim 2, wherein the flap is positioned on the outside of the inner fabric layer and the outer fabric layer.

5. The fabric assembly of claim 2, wherein a top side of the flap is elastically attachable to the underwear, but the other sides are not attachable.

6. The fabric assembly of claim 2, wherein a top side and an adjacent vertical side of the flap are attachable to the underwear, but the other sides are not attachable.

7. The fabric assembly of claim 1, wherein the opening to which the fabric assembly is attached is circular in shape.

8. The fabric assembly of claim 1, wherein the opening to which the fabric assembly is attached is elliptical in shape.

9. The fabric assembly of claim 1, wherein the opening to which the fabric assembly is attached is rectangular or square in shape.

10. An underwear for men having the fabric assembly of claim 1 elastically stitched to an opening on the front side of the underwear.

11. A fabric assembly attachable to the front side of a men's underwear to enable the wearer of the underwear to conveniently take his genital organ out for urination, the assembly comprising:

an inner fabric layer having a horizontal linear slot; and an outer fabric layer having a vertical linear slot, the fabric assembly formed by elastically stitching together the periphery of the inner fabric layer to the periphery of the outer fabric layer, the fabric assembly elastically stitchable to an opening on the front side of a men's underwear, and the fabric assembly having sufficient rigidity such that the horizontal linear slot and the vertical linear slot do not open under the pressure of the genital organ, unless the wearer uses his hands to open the horizontal linear slot and the vertical linear slot.

12. The assembly of claim 11, the assembly further comprising a fabric flap adjacent the linear horizontal linear slot and the vertical linear slot.

13. The fabric assembly of claim 12, wherein the flap is positioned on the inside of the inner fabric layer and the outer fabric layer.

14. The fabric assembly of claim 12, wherein the flap is positioned on the outside of the inner fabric layer and the outer fabric layer.

15. The fabric assembly of claim 12, wherein a top side of the flap is attachable to the underwear, but the other sides are not attachable.

16. The fabric assembly of claim 12, wherein a top side and an adjacent vertical side of the flap are attachable to the underwear, but the other sides are not attachable.

17. The fabric assembly of claim 11, wherein the opening to which the fabric assembly is attached is circular in shape.

18. The fabric assembly of claim 11, wherein the opening to which the fabric assembly is attached is elliptical in shape.

19. The fabric assembly of claim 11, wherein the opening to which the fabric assembly is attached is rectangular or square in shape.

20. An underwear for men having the fabric assembly of claim 11 attached to an opening on the front side of the underwear.

* * * * *